US008469675B2

(12) United States Patent
Stiles, Jr. et al.

(10) Patent No.: US 8,469,675 B2
(45) Date of Patent: Jun. 25, 2013

(54) PRIMING PROTECTION

(75) Inventors: Robert W. Stiles, Jr., Cary, NC (US); Lars Hoffmann Berthelsen, Kolding (DK); Gert Kjaer, Soenderborg (DK); Florin Lungeanu, Egernsund (DK)

(73) Assignees: Pentair Water Pool and Spa, Inc., Sanford, NC (US); Danfoss Low Power Drives, Graasten (DK)

( * ) Notice: Subject to any disclaimer, the term of this patent is extended or adjusted under 35 U.S.C. 154(b) by 1147 days.

(21) Appl. No.: 11/608,001

(22) Filed: Dec. 7, 2006

(65) Prior Publication Data

US 2007/0154321 A1 Jul. 5, 2007

Related U.S. Application Data

(63) Continuation-in-part of application No. 10/926,513, filed on Aug. 26, 2004, and a continuation-in-part of application No. 11/286,888, filed on Nov. 23, 2005.

(51) Int. Cl.
*F04B 49/06* (2006.01)
*G05D 11/00* (2006.01)

(52) U.S. Cl.
USPC ..... 417/44.11; 417/12; 700/282

(58) Field of Classification Search
USPC ..... 417/44.11, 42, 43, 44.1; 700/282
See application file for complete search history.

(56) References Cited

U.S. PATENT DOCUMENTS

| | | | | |
|---|---|---|---|---|
| 1,061,919 | A | | 5/1913 | Miller |
| 2,238,597 | A | | 4/1941 | Page |
| 2,458,006 | A | | 1/1949 | Kilgore |
| 2,488,365 | A | | 11/1949 | Abbott el al. |
| 2,494,200 | A | | 1/1950 | Ramqvist |
| 2,615,937 | A | | 10/1952 | Ludwig et al. |
| 2,716,195 | A | | 8/1955 | Anderson |
| 2,767,277 | A | | 10/1956 | Wirth |
| 2,778,958 | A | | 1/1957 | Hamm et al. |
| 2,881,337 | A | | 4/1959 | Wall |
| 3,191,935 | A | | 6/1965 | Uecker |
| 3,213,304 | A | | 10/1965 | Landerg et al. |
| 3,291,058 | A | * | 12/1966 | McFarlin ..... 417/423.1 |

(Continued)

FOREIGN PATENT DOCUMENTS

| | | |
|---|---|---|
| DE | 19645129 | 5/1998 |
| DE | 10231773 | 2/2004 |

(Continued)

OTHER PUBLICATIONS

"Better, Stronger, Faster;" Pool & Spa News, Sep. 3, 2004; pp. 52-54, 82-84, USA.

(Continued)

*Primary Examiner* — Charles Freay
(74) *Attorney, Agent, or Firm* — Quarles & Brady

(57) ABSTRACT

Embodiments of the invention provide a pumping system for at least one aquatic application. The pumping system includes a pump, a motor coupled to the pump, and a controller in communication with the motor. The controller determines an actual power consumption of the motor and compares the actual power consumption to a reference power consumption. The controller also determines that the pump is in an unprimed condition if the actual power consumption is less than the reference power consumption and that the pump is in a primed condition if the actual power consumption is at least equal to the reference power consumption.

17 Claims, 7 Drawing Sheets

U.S. PATENT DOCUMENTS

| | | | |
|---|---|---|---|
| 3,558,910 | A | 1/1971 | Dale et al. |
| 3,581,895 | A | 6/1971 | Howard et al. |
| 3,613,805 | A | 10/1971 | Lindstad |
| 3,737,749 | A | 6/1973 | Schmit |
| 3,778,804 | A | 12/1973 | Adair |
| 3,787,882 | A | 1/1974 | Fillmore |
| 3,838,597 | A | 10/1974 | Montgomery et al. |
| 3,949,782 | A | 4/1976 | Athey et al. |
| 3,953,777 | A | 4/1976 | McKee |
| 3,963,375 | A | 6/1976 | Curtis |
| 4,021,700 | A | 5/1977 | Ellis-Anwyl |
| 4,041,470 | A | 8/1977 | Slane et al. |
| 4,123,792 | A | 10/1978 | Gephart et al. |
| 4,133,058 | A | 1/1979 | Baker |
| 4,151,080 | A | 4/1979 | Zuckerman et al. |
| 4,168,413 | A | 9/1979 | Halpine |
| 4,241,299 | A | 12/1980 | Bertone |
| 4,263,535 | A | 4/1981 | Jones |
| 4,286,303 | A | 8/1981 | Genheimer et al. |
| 4,319,712 | A | 3/1982 | Bar |
| 4,322,297 | A | 3/1982 | Bajka |
| 4,353,220 | A | 10/1982 | Curwen |
| 4,370,098 | A | 1/1983 | McClain et al. |
| 4,402,094 | A | 9/1983 | Sanders |
| 4,419,625 | A | 12/1983 | Bejot et al. |
| 4,420,787 | A | 12/1983 | Tibbits et al. |
| 4,449,260 | A | 5/1984 | Whitaker |
| 4,473,338 | A | 9/1984 | Garmong |
| 4,494,180 | A | 1/1985 | Streater |
| 4,504,773 | A | 3/1985 | Suzuki et al. |
| 4,505,643 | A | 3/1985 | Millis et al. |
| 4,541,029 | A | 9/1985 | Ohyama |
| 4,610,605 | A | 9/1986 | Hartley |
| 4,620,835 | A | 11/1986 | Bell |
| 4,635,441 | A | 1/1987 | Ebbing et al. |
| 4,647,825 | A | 3/1987 | Profio et al. |
| 4,676,914 | A | 6/1987 | Mills et al. |
| 4,678,404 | A | 7/1987 | Lorett et al. |
| 4,678,409 | A | 7/1987 | Kurokawa |
| 4,686,439 | A | 8/1987 | Cunningham et al. |
| 4,695,779 | A | 9/1987 | Yates |
| 4,703,387 | A | 10/1987 | Miller |
| 4,758,697 | A | 7/1988 | Jeuneu |
| 4,767,280 | A | 8/1988 | Markuson |
| 4,780,050 | A | 10/1988 | Caine et al. |
| 4,795,314 | A | 1/1989 | Prybella |
| 4,834,624 | A | 5/1989 | Jensen |
| 4,837,656 | A | 6/1989 | Barnes |
| 4,841,404 | A | 6/1989 | Marshall et al. |
| 4,864,287 | A | 9/1989 | Kierstead |
| 4,885,655 | A | 12/1989 | Springer et al. |
| 4,891,569 | A | 1/1990 | Light |
| 4,907,610 | A | 3/1990 | Meincke |
| 4,912,936 | A | 4/1990 | Denpou |
| 4,913,625 | A | 4/1990 | Gerlowski |
| 4,963,778 | A | 10/1990 | Jensen |
| 4,971,522 | A | 11/1990 | Butlin |
| 4,977,394 | A | 12/1990 | Manson et al. |
| 4,985,181 | A | 1/1991 | Strada et al. |
| 4,996,646 | A | 2/1991 | Farrington |
| 4,998,097 | A | 3/1991 | Noth et al. |
| 5,026,256 | A | 6/1991 | Kuwabara |
| 5,076,761 | A | 12/1991 | Krohn et al. |
| 5,076,763 | A | 12/1991 | Anastos et al. |
| 5,079,784 | A | 1/1992 | Rist et al. |
| 5,099,181 | A | 3/1992 | Canon |
| 5,100,298 | A | 3/1992 | Shibata et al. |
| RE33,874 | E | 4/1992 | Miller |
| 5,117,233 | A | 5/1992 | Hamos et al. |
| 5,123,080 | A | 6/1992 | Gillett |
| 5,151,017 | A | 9/1992 | Sears et al. |
| 5,156,535 | A | 10/1992 | Budris |
| 5,158,436 | A | 10/1992 | Jensen |
| 5,159,713 | A | 10/1992 | Gaskill et al. |
| 5,167,041 | A | 12/1992 | Burkitt |
| 5,172,089 | A | 12/1992 | Wright et al. |
| 5,240,380 | A | 8/1993 | Mabe |
| 5,324,170 | A | 6/1994 | Anastos et al. |
| 5,327,036 | A | 7/1994 | Carey |
| 5,342,176 | A | 8/1994 | Redlich |
| 5,418,984 | A | 5/1995 | Livingston et al. |
| 5,471,125 | A | 11/1995 | Wu |
| 5,473,497 | A | 12/1995 | Beatty |
| 5,499,902 | A | 3/1996 | Rockwood |
| 5,511,397 | A | 4/1996 | Makino et al. |
| 5,512,883 | A | 4/1996 | Lane |
| 5,518,371 | A | 5/1996 | Wellstein |
| 5,519,848 | A | 5/1996 | Wloka |
| 5,520,517 | A | 5/1996 | Sipin |
| 5,540,555 | A | 7/1996 | Corso et al. |
| 5,545,012 | A | 8/1996 | Anastos et al. |
| 5,548,854 | A | 8/1996 | Bloemer et al. |
| 5,550,753 | A | 8/1996 | Tompkins et al. |
| 5,559,762 | A | 9/1996 | Sakamoto |
| 5,570,481 | A | 11/1996 | Mathis et al. |
| 5,571,000 | A | 11/1996 | Zimmermann |
| 5,577,890 | A | 11/1996 | Nielsen et al. |
| 5,580,221 | A | 12/1996 | Triezenberg |
| 5,598,080 | A | 1/1997 | Jensen |
| 5,604,491 | A | 2/1997 | Coonley et al. |
| 5,614,812 | A | 3/1997 | Wagoner |
| 5,626,464 | A | 5/1997 | Schoenmeyr |
| 5,628,896 | A | 5/1997 | Klingenberger |
| 5,633,540 | A | 5/1997 | Moan |
| 5,672,050 | A | 9/1997 | Webber et al. |
| 5,682,624 | A | 11/1997 | Ciochetti |
| 5,690,476 | A | 11/1997 | Miller |
| 5,711,483 | A | 1/1998 | Hays |
| 5,713,320 | A | 2/1998 | Pfaff et al. |
| 5,727,933 | A | 3/1998 | Laskaris et al. |
| 5,730,861 | A | 3/1998 | Sterghos et al. |
| 5,739,648 | A | 4/1998 | Ellis et al. |
| 5,767,606 | A | 6/1998 | Bresolin |
| 5,791,882 | A | 8/1998 | Stucker |
| 5,804,080 | A | 9/1998 | Klingenberger |
| 5,819,848 | A | 10/1998 | Rasmuson |
| 5,820,350 | A | 10/1998 | Mantey et al. |
| 5,828,200 | A | 10/1998 | Ligman et al. |
| 5,833,437 | A | 11/1998 | Kurth et al. |
| 5,863,185 | A | 1/1999 | Cochimin et al. |
| 5,883,489 | A | 3/1999 | Konrad |
| 5,894,609 | A | 4/1999 | Barnett |
| 5,907,281 | A | 5/1999 | Miller, Jr. et al. |
| 5,909,372 | A | 6/1999 | Thybo |
| 5,914,881 | A | 6/1999 | Trachier |
| 5,920,264 | A | 7/1999 | Kim et al. |
| 5,930,092 | A | 7/1999 | Nystrom |
| 5,941,690 | A | 8/1999 | Lin |
| 5,947,689 | A | 9/1999 | Schick |
| 5,947,700 | A | 9/1999 | McKain et al. |
| 5,959,534 | A | 9/1999 | Campbell et al. |
| 5,969,958 | A | 10/1999 | Nielsen |
| 5,973,465 | A | 10/1999 | Rayner |
| 5,983,146 | A | 11/1999 | Sarbach |
| 5,991,939 | A | 11/1999 | Mulvey |
| 6,030,180 | A | 2/2000 | Clarey et al. |
| 6,037,742 | A | 3/2000 | Rasmussen |
| 6,043,461 | A | 3/2000 | Holling et al. |
| 6,045,331 | A | 4/2000 | Gehm et al. |
| 6,045,333 | A | 4/2000 | Breit |
| 6,046,492 | A | 4/2000 | Machida |
| 6,048,183 | A | 4/2000 | Meza |
| 6,059,536 | A | 5/2000 | Stingl |
| 6,065,946 | A | 5/2000 | Lathrop |
| 6,072,291 | A | 6/2000 | Pedersen |
| 6,091,604 | A | 7/2000 | Plougsgaard |
| 6,098,654 | A | 8/2000 | Cohen et al. |
| 6,102,665 | A | 8/2000 | Centers |
| 6,116,040 | A | 9/2000 | Stark |
| 6,121,746 | A | 9/2000 | Fisher |
| 6,125,481 | A | 10/2000 | Sicilano |
| 6,142,741 | A | 11/2000 | Nishihata |
| 6,157,304 | A | 12/2000 | Bennett et al. |
| 6,171,073 | B1 | 1/2001 | McKain et al. |
| 6,178,393 | B1 | 1/2001 | Irvin |
| 6,199,224 | B1 | 3/2001 | Versland |
| 6,208,112 | B1 | 3/2001 | Jensen |

6,227,808 B1 5/2001 McDonough
6,238,188 B1 5/2001 Lifson
6,249,435 B1 6/2001 Vicente et al.
6,253,227 B1 6/2001 Tompkins et al.
6,254,353 B1 7/2001 Polo
6,257,304 B1 7/2001 Jacobs et al.
6,259,617 B1 7/2001 Wu
6,264,431 B1 7/2001 Triezenberg
6,264,432 B1 7/2001 Kilayko et al.
6,280,611 B1 8/2001 Henkin et al.
6,299,414 B1 10/2001 Schoenmeyr
6,299,699 B1 10/2001 Porat et al.
6,326,752 B1 12/2001 Jensen
6,342,841 B1 1/2002 Stingl
6,349,268 B1 2/2002 Ketonen et al.
6,351,359 B1 2/2002 Jaeger
6,354,805 B1 3/2002 Moller
6,364,621 B1 4/2002 Yamauchi
6,373,728 B1 4/2002 Aarestrup
6,380,707 B1 4/2002 Rosholm
6,388,642 B1 5/2002 Cotis
6,390,781 B1 5/2002 McDonough
6,406,265 B1 6/2002 Hahn
6,415,808 B2 7/2002 Joshi
6,416,295 B1 7/2002 Nagai
6,426,633 B1 7/2002 Thybo
6,447,446 B1 9/2002 Smith et al.
6,450,771 B1 9/2002 Centers
6,464,464 B2 10/2002 Sabim
6,468,042 B2 10/2002 Moller
6,468,052 B2 10/2002 McKain et al.
6,474,949 B1 11/2002 Arai
6,481,973 B1 11/2002 Struthers
6,483,278 B2 11/2002 Harvest
6,493,227 B2 12/2002 Nielsen et al.
6,501,629 B1 12/2002 Marriott
6,504,338 B1 1/2003 Eichorn
6,522,034 B1 2/2003 Nakayama
6,534,940 B2 3/2003 Bell et al.
6,534,947 B2 3/2003 Johnson et al.
6,548,976 B2 4/2003 Jensen
6,623,245 B2 9/2003 Meza
6,636,135 B1 10/2003 Vetter
6,651,900 B1 11/2003 Yoshida
6,676,831 B2 1/2004 Wolfe
6,690,250 B2 2/2004 Moller
6,696,676 B1 2/2004 Graves et al.
6,709,240 B1 3/2004 Schmalz et al.
6,715,996 B2 4/2004 Moeller
6,717,318 B1 4/2004 Mathiassen
6,732,387 B1 5/2004 Waldron
6,747,367 B2 6/2004 Cline
6,770,043 B1 8/2004 Kahn
6,774,664 B2 8/2004 Godbersen
6,799,950 B2 10/2004 Meier et al.
6,806,677 B2 10/2004 Kelly et al.
6,837,688 B2 1/2005 Kimberlin et al.
6,842,117 B2 1/2005 Keown
6,863,502 B2 3/2005 Bishop et al.
6,875,961 B1 4/2005 Collins
6,888,537 B2 5/2005 Benson et al.
6,925,823 B2 8/2005 Lifson
6,933,693 B2 8/2005 Schuchmann
6,941,785 B2 9/2005 Haynes et al.
6,965,815 B1 11/2005 Tompkins et al.
6,976,052 B2 12/2005 Tompkins et al.
6,989,649 B2 1/2006 Mehlhorn
7,005,818 B2 2/2006 Jensen
7,040,107 B2 5/2006 Lee et al.
7,050,278 B2 5/2006 Poulsen
7,083,392 B2 8/2006 Meza
7,117,120 B2 10/2006 Beck et al.
7,183,741 B2 2/2007 Mehlhorn
7,221,121 B2 5/2007 Skaug
7,542,251 B2 6/2009 Ivankovic
2001/0041139 A1 11/2001 Sabini et al.
2002/0010839 A1 1/2002 Tirumala et al.
2002/0018721 A1* 2/2002 Kobayashi et al. ..... 417/44.1
2002/0032491 A1 3/2002 Imamura et al.
2002/0050490 A1 5/2002 Pittman
2002/0070875 A1 6/2002 Crumb
2002/0082727 A1 6/2002 Laflamme et al.
2002/0093306 A1 7/2002 Johnson et al.
2002/0131866 A1* 9/2002 Phillips ..... 417/36
2002/0136642 A1* 9/2002 Moller ..... 417/44.11
2002/0150476 A1 10/2002 Lucke et al.
2002/0190687 A1 12/2002 Bell et al.
2003/0017055 A1 1/2003 Fong
2003/0034284 A1 2/2003 Wolfe
2003/0061004 A1 3/2003 Discenzo
2003/0063900 A1 4/2003 Wang et al.
2003/0099548 A1 5/2003 Meza
2003/0106147 A1 6/2003 Cohen et al.
2003/0174450 A1 9/2003 Nakajima et al.
2003/0196942 A1 10/2003 Jones
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Loyd et al.
2004/0055363 A1 3/2004 Bristol
2004/0062658 A1 4/2004 Beck et al.
2004/0090197 A1 5/2004 Schuchmann
2004/0117330 A1 6/2004 Ehlers et al.
2005/0050908 A1 3/2005 Lee et al.
2005/0095150 A1* 5/2005 Leone et al. ..... 417/423.3
2005/0123408 A1* 6/2005 Koehl ..... 417/53
2005/0137720 A1 6/2005 Spira et al.
2005/0170936 A1 8/2005 Quinn
2005/0190094 A1 9/2005 Andersen
2005/0193485 A1 9/2005 Wolfe
2005/0226731 A1 10/2005 Mehlhorn
2005/0235732 A1* 10/2005 Rush ..... 73/1.16
2006/0045750 A1 3/2006 Stiles
2006/0045751 A1 3/2006 Beckman et al.
2006/0090255 A1 5/2006 Cohen
2006/0127227 A1* 6/2006 Mehlhorn et al. ..... 417/53
2006/0146462 A1 7/2006 McMillian, IV
2006/0204367 A1 9/2006 Meza
2007/0001635 A1 1/2007 Ho
2007/0041845 A1* 2/2007 Freudenberger ..... 417/63
2007/0061051 A1 3/2007 Maddox
2007/0113647 A1 5/2007 Mehlhorn
2007/0114162 A1 5/2007 Stiles et al.
2007/0124321 A1 5/2007 Stiles
2007/0154319 A1 7/2007 Stiles
2007/0154320 A1 7/2007 Stiles
2007/0154322 A1 7/2007 Stiles
2007/0154323 A1 7/2007 Stiles
2007/0160480 A1 7/2007 Ruffo
2007/0163929 A1 7/2007 Stiles
2007/0183902 A1 8/2007 Stiles
2007/0187185 A1 8/2007 Abraham et al.
2007/0212210 A1 9/2007 Kernan et al.
2007/0212229 A1 9/2007 Stavale et al.
2007/0212230 A1 9/2007 Stavale et al.
2008/0003114 A1 1/2008 Levin et al.
2008/0041839 A1 2/2008 Tran
2008/0063535 A1 3/2008 Koehl
2008/0095638 A1 4/2008 Branecky
2008/0131289 A1 6/2008 Koehl
2008/0131291 A1 6/2008 Koehl
2008/0131294 A1 6/2008 Koehl
2008/0131295 A1 6/2008 Koehl
2008/0131296 A1 6/2008 Koehl
2008/0140353 A1 6/2008 Koehl
2008/0152508 A1 6/2008 Meza
2008/0168599 A1 7/2008 Caudill et al.
2008/0181785 A1 7/2008 Koehl
2008/0181786 A1 7/2008 Meza
2008/0181787 A1 7/2008 Koehl
2008/0181788 A1 7/2008 Meza
2008/0181789 A1 7/2008 Koehl
2008/0181790 A1 7/2008 Meza
2008/0260540 A1 10/2008 Koehl
2008/0288115 A1 11/2008 Rusnak et al.
2009/0104044 A1 4/2009 Koehl

FOREIGN PATENT DOCUMENTS

| | | |
|---|---|---|
| DE | 19938490 | 4/2005 |
| EP | 0314249 | 5/1989 |
| EP | 0709575 | 5/1996 |
| EP | 0735273 | 10/1996 |
| EP | 0978657 | 2/2000 |
| FR | 2529965 | 6/1983 |
| FR | 2703409 | 10/1994 |
| JP | 5010270 | 1/1993 |
| WO | WO 98/04835 | 2/1998 |
| WO | WO00/42339 | 7/2000 |
| WO | WO 01/47099 | 6/2001 |
| WO | WO03/099705 | 12/2003 |
| WO | WO 2004/006416 | 1/2004 |
| WO | WO 2004/088694 | 10/2004 |
| WO | WO 2006/069568 | 7/2006 |

OTHER PUBLICATIONS

Danfoss; "VLT8000 Aqua Instruction Manual;" Apr. 16, 2004; pp. 1-71.

"Product Focus—New AC Drive Series Targets Water, Wastewater Applications;" WaterWorld Articles; Jul. 2002; pp. 1-2.

Pentair; "Pentair IntelliTouch Operating Manual;" May 22, 2003; pp. 1-60.

Pentair; "Pentair RS-485 Pool Controller Adapter" Published Advertisement; Mar. 22, 2002; pp. 1-2.

Compool; "Compool CP3800 Pool-Spa Control System Installation and Operating Instructions;" Nov. 7, 1997; pp. 1-45.

Robert S. Carrow; "Electrician's Technical Reference—Variable Frequency Drives;" 2001; pp. 1-194.

Hayward; "Hayward Pro-Series High-Rate Sand Filter Owner's Guide;" 2002; pp. 1-4.

Baldor; "Baldor Motors and Drives Series 14 Vector Drive Control Operating & Technical Manual;" Mar. 22, 1992; pp. 1-92.

Commander; "Commander SE Advanced User Guide;" Nov. 2002; pp. 1-118.

Danfoss; "Danfoss VLT 6000 Series Adjustable Frequency Drive Installation, Operation and Maintenance Manual;" Mar. 2000; pp. 1-118.

Baldor; "Baldor Series 10 Inverter Control: Installation and Operating Manual;" Feb. 2000; pp. 1-74.

Dinverter; "Dinverter 2B User Guide;" Nov. 1998; pp. 1-94.

54DX18—StMicroelectronics; "AN1946—Sensorless BLDC Motor Control & BEMF Sampling Methods with ST7MC;" 2007; pp. 1-35; Civil Action 5:11-cv-00459D.

54DX19—StMicroelectronics; "AN1276 BLDC Motor Start Routine for ST72141 Microcontroller;" 2000; pp. 1-18; cited in Civil Action 5:11-cv-00459D.

54DX22—Danfoss; "VLT 8000 Aqua Instruction Manual; " Undated; pp. 1-35; cited in Civil Action 5:11-cv-00459D.

54DX30—Sabbagh et al., "A Model for Optimal. . . Control of Pumping Stations in Irrigation Systems; " July 1988; NL pp. 119-133; Civil Action 5:11-cv-00459D.

54DX31—Danfoss; "VLT 5000 FLUX Aqua DeviceNet Instruction Manual;" Apr. 28, 2003; pp. 1-39; cited in Civil Action 5:11-cv-00459D.

54DX32—Danfoss; "VLT 5000 FLUX Aqua Profibus Operation Instructions;" May 22, 2003; pp. 1-64; cited in Civil Action 5:11-cv-00459D.

54DX31—Pentair Advertisement in "Pool & Spa News;" Mar. 22, 2002; pp. 1-3; cited in Civil Action 5:11-cv-00459D.

54DX37—Danfoss; "VLT 8000 Aqua Fact Sheet;" Jan. 2002; pp. 1-3; cited in Civil Action 5:11-cv-00459D.

* cited by examiner

PRIMING PROTECTION

RELATED APPLICATIONS

This application is a continuation-in-part application of U.S. application Ser. No. 10/926,513, filed Aug. 26, 2004, and U.S. application Ser. No. 11/286,888, filed Nov. 23, 2005, the entire disclosures of which are hereby incorporated herein by reference.

FIELD OF THE INVENTION

The present invention relates generally to control of a pump, and more particularly to control of a variable speed pumping system for a pool, a spa or other aquatic application.

BACKGROUND OF THE INVENTION

Conventionally, a pump to be used in an aquatic application such as a pool or a spa is operable at a finite number of predetermined speed settings (e.g., typically high and low settings). Typically these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the aquatic application conditions and/or pumping demands.

Generally, pumps of this type must be primed before use. For example, the pump and the pumping system should be filled with liquid (e.g., water) and contain little or no gas (e.g., air), or else the pump may not prime. If the pump is operated in an unprimed condition (e.g., the gas has not been removed from the system), various problems can occur, such as an overload condition or loss of prime condition. In another example, if too much gas is in the system, a dry run condition can occur that can cause damage to the pump. In yet other examples, operation of the pump in an unprimed condition can cause a water hammer condition and/or a voltage spike that can damage the pump and/or even various other elements of the pumping system.

Conventionally, to prime a pump, a user can manually fill the pump with water and operate the pump, in a repetitious fashion, until the pump is primed. However, the user must be careful to avoid the aforementioned problems associated with operating the pump in an unprimed condition during this process. Thus, it would be beneficial to utilize an automated priming function to operate the pump according to an automated program, or the like, that can monitor the priming status and can automatically alter operation of the pump to avoid the aforementioned problems. However, since each aquatic application is different, the automated priming function must be adjustable and/or scalable, such as in terms of water flow or pressure through the system and/or time required to prime the pump of a specific aquatic application.

Accordingly, it would be beneficial to provide a pumping system that could be readily and easily adapted to respond to a variety of priming conditions. Further, the pumping system should be responsive to a change of conditions and/or user input instructions.

SUMMARY OF THE INVENTION

In accordance with one aspect, the present invention provides a method of determining a priming status of a pumping system for moving water of an aquatic application. The pumping system includes a water pump for moving water in connection with performance of an operation upon the water and a variable speed motor operatively connected to drive the pump. The method comprises the steps of determining a reference power consumption of the motor based upon a performance value of the pumping system and determining an actual power consumption of the motor. The method further comprises the steps of comparing the reference power consumption and the actual power consumption, and determining a priming status of the pumping system based upon the comparison of the reference power consumption and the actual power consumption.

In accordance with another aspect, the present invention provides a method of determining a priming status of a pumping system for moving water of an aquatic application. The pumping system includes a water pump for moving water in connection with performance of an operation upon the water and a variable speed motor operatively connected to drive the pump. The method comprising the steps of operating the motor at a motor speed, determining a reference power consumption of the motor based upon the motor speed, and determining an actual power consumption of the motor when the motor is operating at the motor speed. The method further comprises the steps of determining a determined value based upon a comparison of the reference power consumption and the actual power consumption, determining a priming status of the pumping system based upon the determined value, the priming status being unprimed when the determined value exceeds a first predetermined threshold and the priming status being primed when the determined value exceeds a second predetermined threshold, and altering control of the motor based upon the priming status.

In accordance with another aspect, the present invention provides a pumping system for moving water of an aquatic application. The pumping system includes a water pump for moving water in connection with performance of an operation upon the water and a variable speed motor operatively connected to drive the pump. The pumping system further includes means for determining a reference power consumption of the motor based upon a performance value of the pumping system, means for determining an actual power consumption of the motor; and means for comparing the reference power consumption and the actual power consumption. The pumping system further includes means for determining a priming status of the pumping system based upon the comparison of the reference power consumption and the actual power consumption, the priming status including at least one of the group of a primed condition and an unprimed condition.

In accordance with another aspect, the present invention provides a pumping system for moving water of an aquatic application. The pumping system includes a water pump for moving water in connection with performance of an operation upon the water and a variable speed motor operatively connected to drive the pump. The pumping system further includes means for operating the motor at a motor speed, means for determining a reference power consumption of the motor based upon the motor speed, and means for determining an actual power consumption of the motor when the motor is operating at the motor speed. The pumping system further includes means for determining a determined value based upon a comparison of the reference power consumption and the actual power consumption, means for determining a priming status of the pumping system based upon the determined value, the priming status being unprimed when the determined value exceeds a first predetermined threshold and the priming status being primed when the determined value exceeds a second predetermined threshold, and means for altering control of the motor based upon the priming status.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
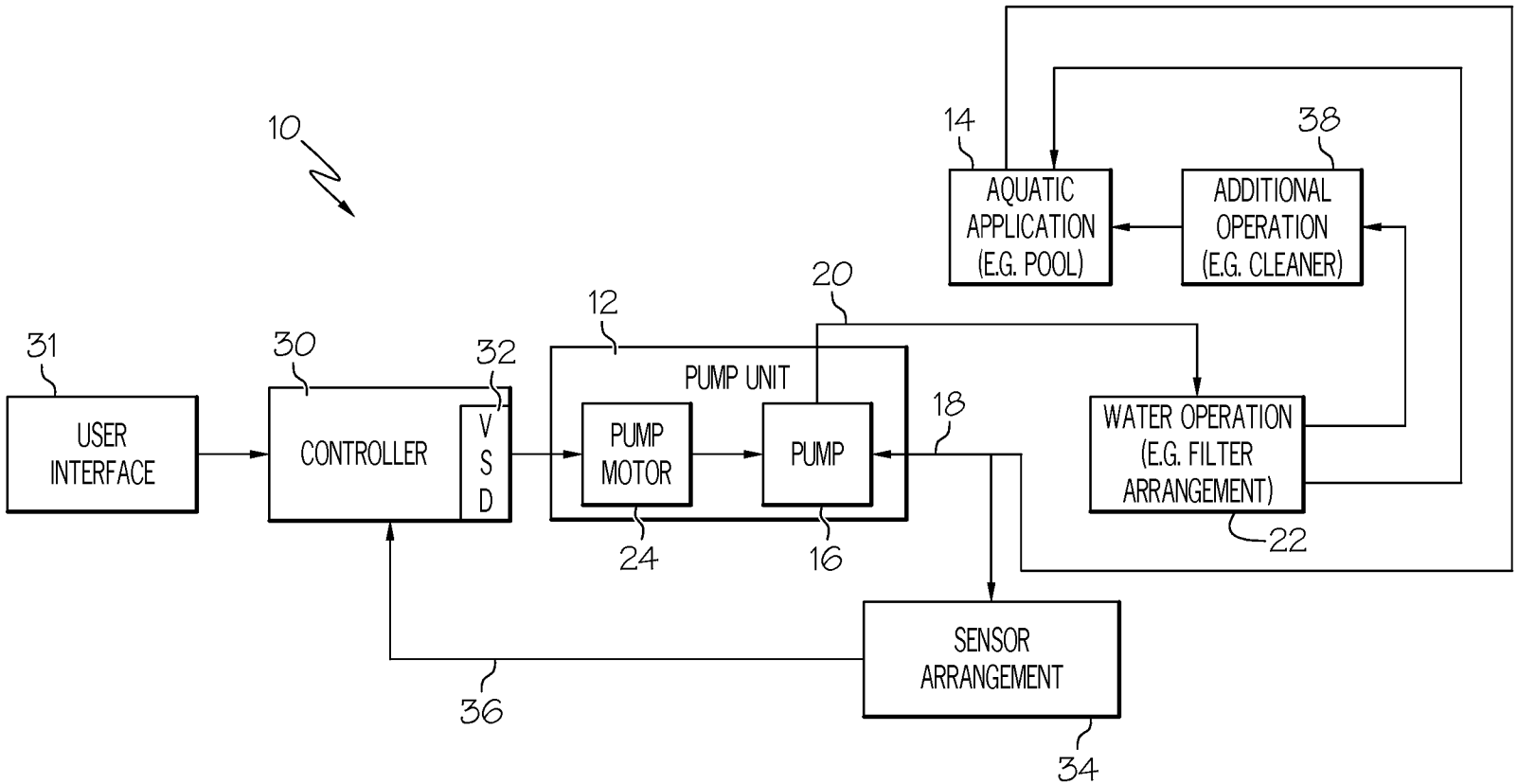
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., re-circulation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. Thus, either or both of the pump 16 and/or the motor 24 can be configured to consume power during operation.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit. Further still, the controller 30 can receive input from a user interface 31 that can be operatively connected to the controller in various manners.

The pumping system 10 has means used for control of the operation of the pump. In accordance with one aspect of the present invention, the pumping system 10 includes means for sensing, determining, or the like one or more parameters or performance values indicative of the operation performed upon the water. Within one specific example, the system includes means for sensing, determining or the like one or more parameters or performance values indicative of the movement of water within the fluid circuit.

The ability to sense, determine or the like one or more parameters or performance values may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 can include at least one sensor used to determine flow rate of the water moving within the fluid circuit and/or includes at least one sensor used to determine flow pressure of the water moving within the fluid circuit. In one example, the sensor arrangement 34 can be operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto. Further still, one or more sensor arrangement(s) 34 can be used to sense parameters or performance values of other components, such as the motor (e.g., motor speed or power consumption) or even values within program data running within the controller 30.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the aquatic application to the pump such as debris accumulation or the lack of accumulation, within the filter arrangement 34. As such, the monitored information is indicative of the condition of the filter arrangement.

Figure 2:
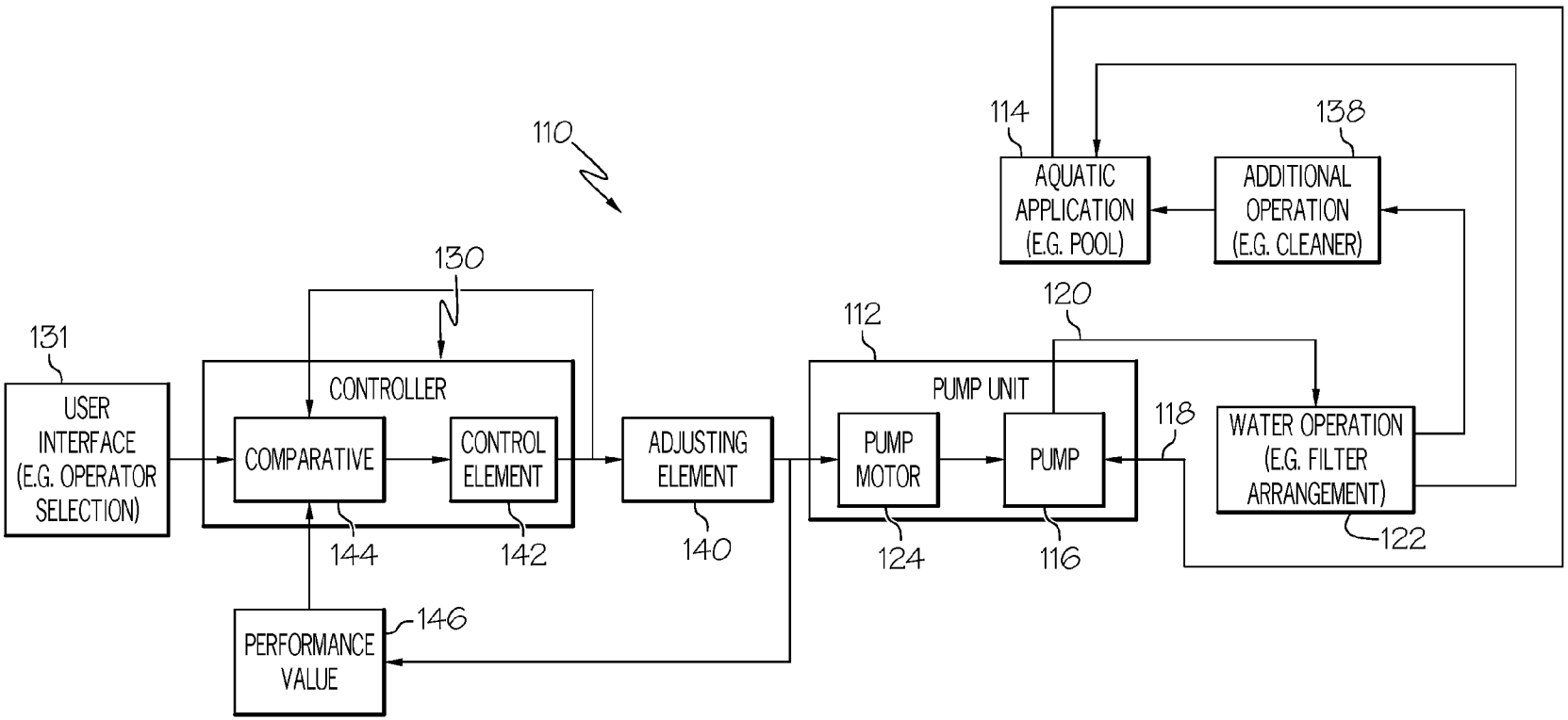
FIG. 2 is another block diagram of another example of a variable speed pumping system in accordance with the present invention with a pool environment.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such additional water movement may be used to supplant the need for other water movement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the controller 130 can receive input from a user interface 131 that can be operatively connected to the controller in various manners.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter or performance value is power consumption. Pressure and/or flow rate can be calculated/determined from such pump parameter(s).

Although the system 110 and the controller 130 may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from a performance value 146.

The performance value 146 can be determined utilizing information from the operation of the pump motor 124 and controlled by the adjusting element 140. As such, a feedback iteration can be performed to control the pump motor 124. Also, operation of the pump motor and the pump can provide the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine various performance characteristics of the pumping system 110, such as input power consumed, motor speed, flow rate and/or the flow pressure. Thus, the controller (e.g., 30 or 130) provides the control to operate the pump motor/pump accordingly. In one example, the operation can be configured to prevent damage to a user or to the pumping system 10, 110 caused by a dry run condition. In other words, the controller (e.g., 30 or 130) can repeatedly monitor one or more performance value(s) 146 of the pumping system 10,110, such as the input power consumed by, or the speed of, the pump motor (e.g., 24 or 124) to sense or determine an unprimed status of the pumping system 10, 110.

Figure 3A:
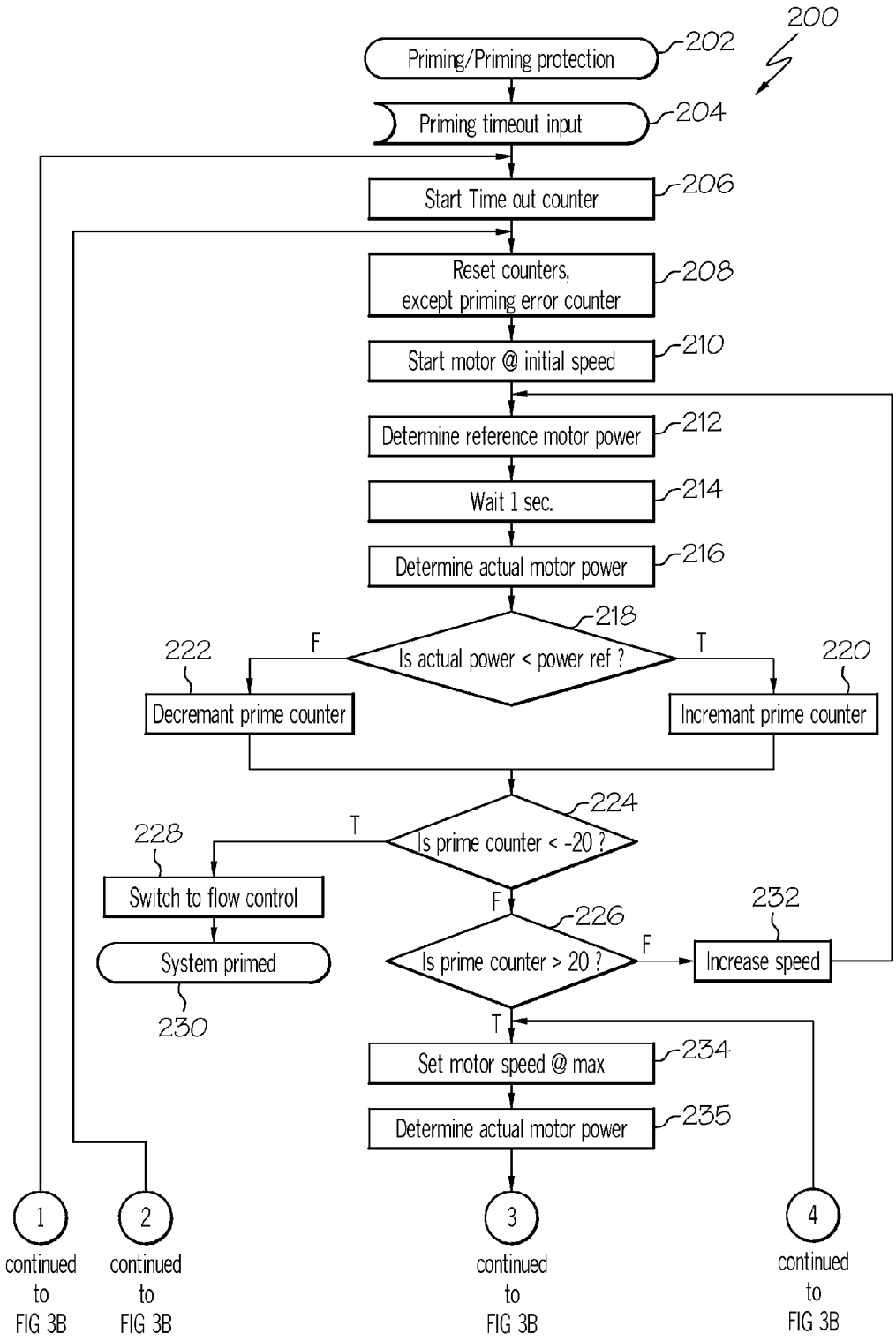
FIGS. 3A and 3B are a flow chart of an example of a process in accordance with an aspect of the present invention.
Figure 3B:
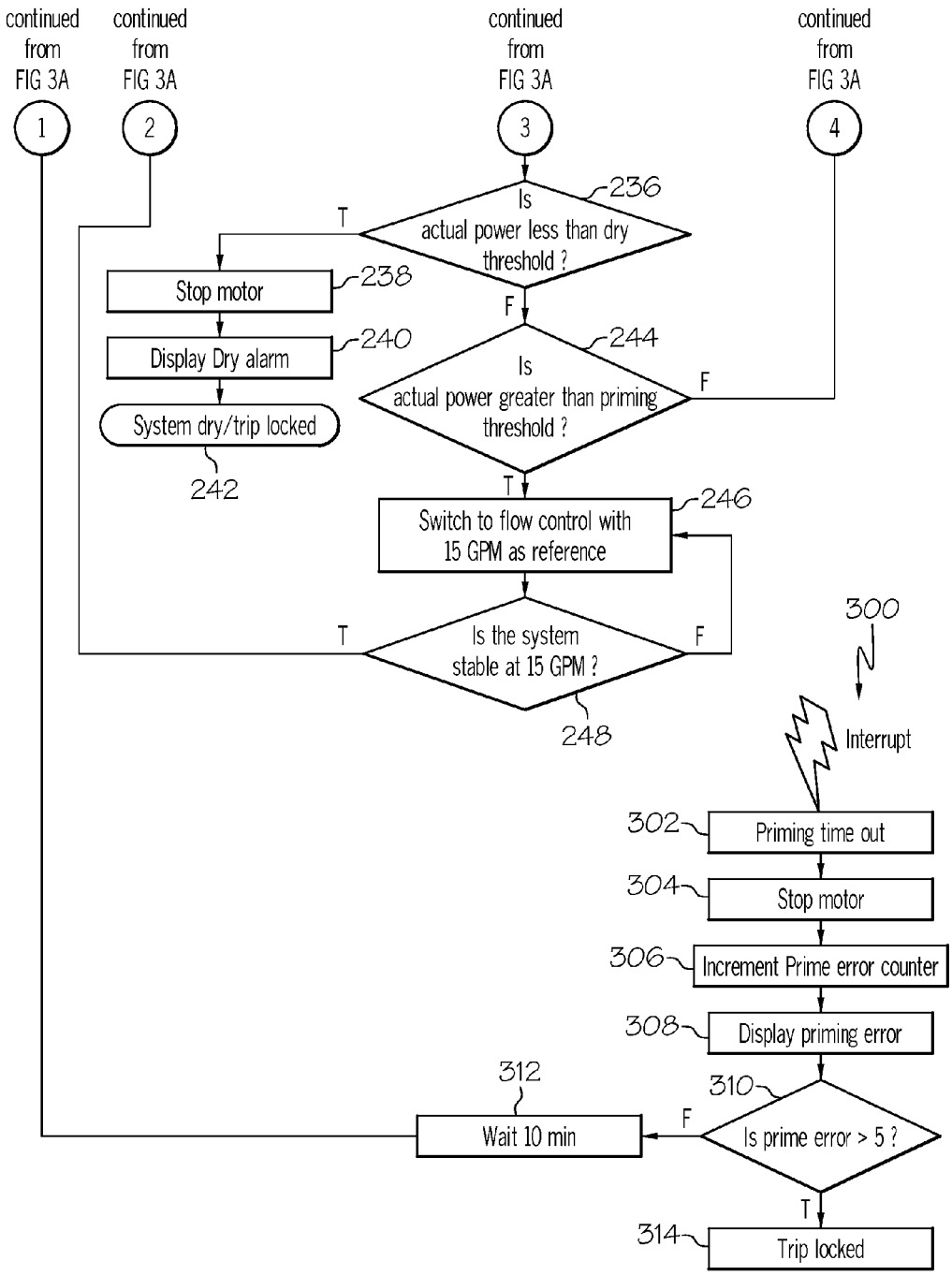

Turning to one specific example, attention is directed to the process chart that is shown in FIGS. 3A and 3B. It is to be appreciated that the process chart as shown is intended to be only one example method of operation, and that more or less steps can be included in various orders. Additionally, the example process can be used during startup of the pump 12, 112 to ensure a primed condition, and/or it can also be used to later ensure that an operating pump 12, 112 is maintaining a primed condition. For the sake of clarity, the example process described below can determine a priming status of the pumping system based upon power consumption of the pump unit 12, 112 and/or the pump motor 24, 124, though it is to be appreciated that various other performance values (i.e., motor speed, flow rate and/or flow pressure of water moved by the pump unit 12, 112, or the like) can also be used for a determination of priming status (e.g., though either direct or indirect measurement and/or determination). In one example, an actual power consumption of the motor 24, 124 can be compared against a reference (e.g., expected) power consumption of the motor 24, 124. When the priming status is in an unprimed condition, the motor 24, 124 will generally consume less power than the reference power consumption. Conversely, when the priming status is in a primed condition, the motor 24, 124 will generally consume an equal or greater amount of power as compared to the reference power consumption.

In another example, when the priming status is in an unprimed condition or the pumping system 10, 110 loses prime, the power consumed by the pump unit 12, 112 and/or pump motor 24, 124 can decrease. Thus, an unprimed condition or loss of prime can be detected upon a determination of a decrease in power consumption and/or associated other performance values (e.g., relative amount of decrease, comparison of decreased values, time elapsed, number of consecutive decreases, etc.). Power consumption can be determined in various ways. In one example, the power consumption can be based upon a measurement of electrical current and electrical voltage provided to the motor 24, 124. Various other factors can also be included, such as the power factor, resistance, and/or friction of the motor 24, 124 components, and/or even physical properties of the aquatic application, such as the temperature of the water.

In yet another example, the priming status can be determined based upon a measurement of water flow rate. For example, when an unprimed condition or loss of prime is present in the pumping system 10, 110, the flow rate of the water moved by the pump unit 12, 112 and/or pump motor 24, 124 can also decrease, and the unprimed condition can be determined from a detection of the decreased flow rate. In another example, the priming status can be determined based upon a comparison of determined reference and actual water flow rates.

As shown by FIGS. 3A and 3B, the process 200 can be contained within a constantly repeating loop, such as a "while" loop, "if-then" loop, or the like, as is well known in the art. In one example, the "while" or "if-then" loop can cycle at predetermined intervals, such as once every 100 milliseconds. Further, it is to be appreciated that the loop can include various methods of breaking out of the loop due to various conditions and/or user inputs. In one example, the loop could be broken (and the program stopped and/or restarted) if a user input value is changed. In another example, the loop could be broken if an interrupt command is issued. Interrupt signals, as are well known in the art, allow a processor (e.g., controller 30, 130) to process other work while an event is pending. For example, the process 200 can include a timer that is configured to interrupt the process 200 after a predetermined threshold time has been reached, though various other interrupt commands and/or processes are also contemplated to be within the scope of the invention. It is to be appreciated that the interrupt command can originate from the controller 30, 130, though it can also originate from various other processes, programs, and/or controllers, or the like.

The process 200 is initiated at step 202, which is merely a title block, and proceeds to step 204. At step 204, information can be retrieved from a filter menu, such as the user interface 31, 131. The information may take a variety of forms and may have a variety of contents. As one example, the information can include user inputs related a timeout value. Thus, a user can limit the amount of time the system can take to attempt to successfully prime. For example, a user can limit the process time to 5 minutes such that the process 200 stops the motor 24, 124 if the system remains in an unprimed status for a time exceeding the user input 5 minute timeout value, though various other times are also contemplated to be within the scope of the invention. In addition or alternatively, the information of step 204 can be calculated or otherwise determined (e.g., stored in memory or found in a look-up table, graph, curve or the like), and can include various forms, such as a value (e.g., "yes" or "no", a numerical value, or even a numerical value within a range of values), a percentage, or the like. It should be appreciated that such information (e.g., times, values, percentages, etc.) is desired and/or intended, and/or preselected/predetermined.

It is to be appreciated that even further information can be retrieved from a filter menu or the like (e.g., user interface 31, 131). In one example, the additional information can relate to an "auto restart" feature that can be adapted to permit the pumping system 10, 110 to automatically restart in the event that it has been slowed and/or shut down due to an unsuccessful priming condition. As before, the information can include various forms, such as a value (e.g., 0 or 1, or "yes" or "no"), though it can even comprise a physical switch or the like. It is to be appreciated that various other information can be input by a user to alter control of the priming protection system.

Subsequent to step 204, the process 200 can proceed onto step 206. At step 206, the process 200 can start/initialize the timeout timer. The timeout timer can include various types. In one example, the timeout timer can include a conventional timer that counts upwards or downwards in units of time (seconds, minutes, etc.). In another example, the timeout timer can include an electronic element, such as a capacitor or the like, that can increase or decrease an electrical charge over time.

Subsequent to step 206, the process 200 can proceed onto step 208. As can be appreciated, it can be beneficial to reset and/or initialize the various counters (e.g., timeout counter, retry counter, prime counter, etc.) of the process 200. For example, the timeout counter of step 206 can be reset and/or initialized. As can be appreciated, because the counters can include various types, each counter can be reset and/or initialized in various manners. For example, a clock-based timeout counter can be reset to a zero time index, while a capacitor-based timeout counter can be reset to a particular charge. However, it is to be appreciated that various counters may not be reset and/or initialized. For example, because the process 200 can be a repeating process within a "while" loop or the like, various counters may be required during various cycles of the program. For example, it can be beneficial not to reset the retry/prime-error counter between program loops to permit cumulative counting during process restarts.

Subsequent to step 208, the process can proceed onto step 210 to operate the motor 24, 124 at a motor speed. During a first program cycle, step 210 can operate the motor 24, 124 at an initial motor speed. However, during a subsequent program cycle, step 210 can operate the motor 24, 124 at various other motor speeds. The motor speed of the motor 24, 124 can be determined in various manners. In one example, the motor speed can be retrieved from a user input. In another example, the motor speed can be determined by the controller 30, 130 (e.g., calculated, retrieved from memory or a look-up table, graph, curve, etc). In yet another example, during subsequent program cycles, the motor speed can be increased or decreased from a previous program cycle.

Subsequent to step 210, the process 200 can determine a reference power consumption of the motor 24, 124 (e.g., watts or the like) based upon a performance value of the pumping system 10, 110. In one example, step 210 can determine a reference power consumption of the motor 24, 124 based upon the motor speed, such as by calculation or by values stored in memory or found in a look-up table, graph, curve or the like. In one example, the controller 30, 130 can contain a one or more predetermined pump curves or associated tables using various variables (e.g., flow, pressure, speed, power, etc.). The curves or tables can be arranged or converted in various manners, such as into constant flow curves or associated tables. For example, the curves can be arranged as a plurality of power (watts) versus speed (RPM) curves for discrete flow rates (e.g., flow curves for the range of 15 GPM to 130 GPM in 1 GPM increments) and stored in the computer program memory. Thus, for a given flow rate, one can use a known value, such as the motor speed to determine (e.g., calculate or look-up) the reference power consumption of the motor 24, 124. The pump curves can have the data arranged to fit various mathematical models, such as linear or polynomial equations, that can be used to determine the performance value.

Additionally, where the pump curves are based upon constant flow values, a reference flow rate for the pumping system 10, 110 should also be determined. The reference flow rate can be determined in various manners, such as by being retrieved from a program menu through the user interface 31, 131 or from other sources, such as another controller and/or program. In addition or alternatively, the reference flow rate can be calculated or otherwise determined (e.g., stored in memory or found in a look-up table, graph, curve or the like) by the controller 30, 130 based upon various other input values. For example, the reference flow rate can be calculated based upon the size of the swimming pool (i.e., volume), the number of turnovers per day required, and the time range that the pumping system 10, 110 is permitted to operate (e.g., a 15,000 gallon pool size at 1 turnover per day and 5 hours run time equates to 50 GPM). The reference flow rate may take a variety of forms and may have a variety of contents, such as a direct input of flow rate in gallons per minute (GPM).

Subsequent to step 212, the process 200 can proceed to step 214 to pause for a predetermined amount of time to permit the pumping system 10, 110 to stabilize from the motor speed change of step 210. As can be appreciated, power consumption of the motor 24, 124 can fluctuate during a motor speed change transition and/or settling time. Thus, as show, the process 200 can pause for 1 second to permit the power consumption of the motor 24 124 to stabilize, though various other time intervals are also contemplated to be within the scope of the invention.

Subsequent to step 214, the process can determine an actual power consumption of the motor 24, 124 when the motor is operating at the motor speed (e.g., from step 210). The actual power consumption can be measured directly or indirectly, as can be appreciated. For example, the motor controller can determine the present power consumption, such as by way of a sensor configured to measure, directly or indirectly, the electrical voltage and electrical current consumed by the motor 24, 124. Various other factors can also be included, such as the power factor, resistance, and/or friction of the motor 24, 124 components. In addition or alternatively, a change in actual power consumption over time (e.g., between various program cycles) can also be determined. It is to be appreciated that the motor controller can provide a direct value of present power consumption (i.e., watts), or it can provide it by way of an intermediary or the like. It is also to be appreciated that the present power consumption can also be determined in various other manners, such as by way of a sensor (not shown) separate and apart from the motor controller.

Subsequent to step 216, the process 200 can proceed onto step 218 to determine a determined value based upon a comparison of the reference power consumption and the actual power consumption. In one example, as shown, step 218 can be in the form of an "if-then" comparison such that if the actual power consumption is less than or greater than the reference power consumption, step 218 can output a true or false parameter, respectively. As stated previously, it is to be appreciated that when the priming status is in an unprimed condition, the motor 24, 124 will generally consume less power than the reference power consumption, and conversely, when the priming status is in a primed condition, the motor 24, 124 will generally consume an equal or greater amount of power as compared to the reference power consumption. Thus, as shown, if the actual power consumption is less than the reference power consumption (e.g., TRUE), the process 200 can proceed onto step 220 to increment (e.g., increase) a prime counter. For example, the prime counter can be increased by +1. Alternatively, if the actual power consumption is greater than the reference power consumption (e.g., FALSE), the process 200 can proceed onto step 222 to decrement (e.g., decrease) the prime counter (e.g., −1). Thus, it is to be appreciated that the determined value can include the prime counter, though it can also include various other values based upon other comparisons of the reference power consumption and the actual power consumption of the motor 24, 124. In addition or alternatively, in step 318, the actual power consumption can be compared against a previous actual power consumption of a previous program or time cycle (i.e., the power consumption determination made during the preceding program or time cycle) for a determination of a change in power consumption.

Subsequent to steps 220 and 222, the process 200 can proceed onto steps 224 and/or 226 to determine a priming status of the pumping system based upon the determined value (e.g., the prime counter). In steps 224 and 226, the process can determine the priming status based upon whether the prime counter exceeds one or more predetermine thresholds. For example, in step 224, the process 200 can determine whether the prime counter is less than −20. If the prime counter is less than −20 (e.g., TRUE), then the process 200 can be considered to be in a primed condition (e.g., see title block 230) and proceed onto step 228 to control the pumping system 10, 110 via a flow control scheme. That is, once the priming status is determined to be in a primed condition, control of the motor can be altered to adjust a flow rate of water moved by the pump unit 12, 112 towards a constant value (e.g., 15 GPM or other flow rate value). Additionally, once the system is determined to be in a primed condition, the process 200 can end until the pump is in need of further priming and/or a recheck of the priming status.

Alternatively, if the prime counter is not less than −20 (e.g., FALSE), then the process 200 can proceed onto step 226. In step 226, the process 200 can determine whether the prime counter is greater than +20. If the prime counter is not greater than +20 (e.g., FALSE), then the process 200 can be considered to be in a first unprimed condition and can proceed onto step 232 to increase the motor speed. In one example, the motor speed can be increased by 20 RPM, though various other speed increases can also be made. It is to be appreciated that various other changes in motor speed can also be performed, such as decreases in motor speed, and/or increasing/decreasing cycle fluctuations.

Additionally, after increasing the motor speed in step 232, the process can repeat steps 212-226 with the increased motor speed. That is, the process 200 can determine a new reference motor power consumption (step 212) based upon the new, increased motor speed, can determine the actual motor power consumption when the motor is operating at the increased motor speed (step 216), and can make the aforementioned comparison between the actual and reference power consumptions (step 218). The process 200 can then determine whether to increase or decrease the prime counter (steps 218-222), determine the prime status (steps 224-226), and alter control of the motor accordingly. It is to be appreciated that, because the prime counter can be reset at the beginning of the process 200, both of steps 224 and 226 should register as false conditions during at least the first nineteen cycle iterations (e.g., if the prime counter is reset to zero, and is increased or decreased by one during each cycle, it will take at least 20 program cycles for either of steps 224 or 226 for the prime counter to register +/−20). Thus, during the example general priming cycle process 200 shown herein, it is normal for both of steps 224 and 226 to output a false register during at least the first nineteen program cycle iterations.

Turning back to step 226, if the process 200 determines that the prime counter is greater than +20, (e.g., TRUE), then the priming status can be considered to be in a second unprimed condition, and the process 200 can proceed onto step 234. If the priming status is determined to be in the second unprimed condition, it can indicate that the pumping system 10, 110 is having difficulty achieving a primed condition for a variety of reasons. Accordingly, in step 234, the process 200 can increase the motor speed to the maximum motor speed in an attempt to draw in a greater volume of water into the pump 12, 112 to thereby reduce the amount of gas in the system.

However, in the event that the pumping system 10, 110 is having a difficult time priming because of excess gas in the system, running the motor at a maximum speed can create a dry run condition that can damage the pump 24, 124. As such, the process 200 can proceed onto steps 235 and 236 to provide a protection against a dry run condition. In step 235, the process 200 can determine the actual motor power consumption when the motor is operating at maximum speed using any of the various methodologies discussed herein.

Next, in step 236, the process 200 can determine whether the actual power consumption of the motor 24, 124 exceeds a dry run power consumption threshold. For example, in step 236, the process 200 can determine whether the actual motor power consumption is less than a dry run power consumption threshold. If the motor power consumption is less than the dry threshold (e.g., TRUE), then the process can proceed onto step 238 to stop operation of the motor 24, 124 to avoid a dry run condition can. In addition or alternatively, in step 240, the process 200 can also be configured to provide a visual and/or audible indication of dry run condition. For example, the process 200 can display a text message such as "Alarm: Dry Run" on a display, such as an LCD display, or it can cause an alarm light, buzzer, or the like to be activated to alert a user to the dry run condition. In addition or alternatively, the process 200 can lock the system in step 242 to prevent the motor 24, 124 from further operation during the dry run condition. The system can be locked in various manners, such as for a predetermined amount of time or until a user manually unlocks the system.

However, if the pumping system 10, 110 is not in a dry run condition (e.g., step 236 is FALSE), then the process can proceed onto step 238. In step 238, the process 200 can determine whether the actual power consumption of the motor operating at maximum motor speed is greater than a predetermined threshold. For example, the process 200 can determine whether the actual power consumption is greater than a priming power threshold when the motor is operating at maximum speed. If the actual power consumption is less than the priming power threshold (e.g., FALSE), then, because the system remains in an unprimed condition, the process 200 can repeat steps 234-244 to operate the motor at the maximum speed to thereby encourage a greater volume of water to move through the pump 12, 112 to reduce gas in the system. The process 200 can continue to repeat steps 234-244 until the timeout interrupt condition occurs, or until the system eventually becomes primed.

However, in step 244, if the actual power consumption is greater than the priming power threshold (e.g., TRUE, operation of the motor at a maximum speed has encouraged the priming status towards a primed condition), the process can proceed onto step 246. In step 246, the process 200 can control the pumping system 10, 110 via a flow control scheme. That is, the process 200 can alter control the motor 24, 124 to adjust a flow rate of water moved by the pump unit 12, 112 towards a constant value (e.g., 15 GPM or other flow rate value). Next, the process 200 can determine whether the pumping system 10, 110 is stable at the constant flow rate (e.g., 15 GPM) to ensure a generally constant actual power consumption of the motor, and to avoid a transient and/or settling response by the motor. If the system is determined not to be stable at the constant flow rate, the process 200 can repeat steps 246-248 until the system becomes stable, or until the timeout interrupt condition occurs. It is to be appreciated that various methods can be used to determine whether the system is stable. For example, the process 200 can determine that the system is stable by monitoring the actual power consumption of the motor over time and/or the flow rate or flow pressure of the water to ensure that the system is not in a transition and/or settling phase.

Keeping with step 248, if the process determines that the system is stable, the process can proceed back to step 208 to repeat the priming process to thereby ensure that the system is in fact primed. Thus, the process 200 can repeat steps 208-248 until the priming status achieves a primed condition, or until the timeout interrupt condition occurs, whichever is first.

Keeping with FIG. 3B, the process 200 can also include a timeout interrupt routine 300. The timeout interrupt routine 300 can act to protect the pump 12, 112 from damage in the event that the priming status remains in an unprimed condition for an amount of time that exceeds a predetermined amount of time. As stated previously, the timeout interrupt routine 300 operates as an interrupt, as is known in the art, which can break the process 200 loop if an interrupt command is issued. It is to be appreciated that the priming timeout routine 300 described herein is merely one example of an interrupt routine, and that various other interrupt routines can also be used.

The timeout interrupt routine 300 can operate in various manners to trigger a priming timeout interrupt command of step 302. In one example, the process 200 can include a timer (e.g., digital or analog) that is initialized and begins counting upwards or downwards in units of time (seconds, minutes, etc.) as previously discussed in steps 206-208. Thus, if the time counted by the timer exceeds a threshold time (e.g., the timeout input determined in step 204), and the priming status remains in an unprimed condition, the timeout interrupt routine 300 will trigger the interrupt command in step 302. However, it is to be appreciated that the timer can various other mechanical and/or electronic elements, such as a capacitor or the like, that can increase and/or decrease an electrical charge over time to provide a timing function.

Subsequent to the interrupt trigger of step 302, the timeout interrupt routine 300 can proceed onto step 304 to alter operation of the motor 24, 124, such as by stopping the motor. Thus, the timeout interrupt routine 300 can act to protect the motor 24, 124 by inhibiting it from continuously operating the pump 12, 112 in an unprimed condition. Following step 304, the timeout interrupt routine 300 can increment a prime error counter in step 306. The prime error counter can enable the timeout interrupt routine 300 to keep track of the number of failed priming attempts.

In addition or alternatively, in step 308, the timeout interrupt routine 300 can also be configured to provide a visual and/or audible indication of a priming error. For example, the process 200 can display a text message such as "Alarm: Priming Error" on a display, such as an LCD display, or it can cause an alarm light, buzzer, or the like to be activated to alert a user to the priming error.

Next, in step 310, the timeout interrupt routine 300 can determine whether the prime error counter of step 306 exceeds a prime error threshold. For example, as shown, if the timeout interrupt routine 300 determines that the prime error counter is less than five (e.g., FALSE), the routine 300 can proceed onto step 312. In step 312, the routine 300 can cause the priming process 200 to pause for a predetermined amount of time, such as ten minutes, to provide a settling period for the various components of the pumping system 10, 110. Following step 312, the timeout interrupt routine 300 can permit the priming process 200 to restart with step 206, wherein the timeout counter is re-initialized and the process 200 restarted. It is to be appreciated that various other prime error thresholds (e.g., step 310) and various other pause times (e.g., step 312) are also contemplated to be within the scope of the invention, and that the prime error thresholds and/or pause times can be retrieved from memory or input by a user.

Alternatively, if the timeout interrupt routine 300 determines that the prime error counter is greater than five (e.g., TRUE), then the routine 300 can proceed onto step 314 to lock the system. For example, if the routine 300 determines that the prime error counter is greater than the prime error threshold, it can indicate that the process 200 is having continued difficulty priming the pumping system 10, 110 without user intervention. Thus, locking the system can inhibit the motor 24, 124 from further operation in an unprimed condition after several unsuccessful attempts. The system can be locked in various manners, such as for a predetermined amount of time or until a user manually unlocks the system. The lockout step 314 can inhibit and/or prevent the pump unit 12, 112 and/or the motor 24, 124 from restarting until a user takes specific action. For example, the user can be required to manually restart the pump unit 12, 112 and/or the motor 24, 124 via the user-interface 31, 131, or to take other actions.

Additionally, it is to be appreciated that, for the various counters utilized herein, the process 200 and/or routine 300 can be configured to count a discrete number of occurrences (e.g., 1, 2, 3), and/or can also be configured to monitor and/or react to non-discrete trends in data. For example, instead of counting a discrete number of occurrences of an event, the process 200 and/or means for counting could be configured to monitor an increasing or decreasing performance value and to react when the performance value exceeds a particular threshold. In addition or alternatively, the process 200 and/or routine 300 can be configured to monitor and/or react to various changes in a performance value with respect to another value, such as time, another performance value, priming status, or the like.

Further still, the various comparisons discussed herein (e.g., at least steps 218, 224, 226, 236, 244, 248, 310) can also include various other "if-then" statements, sub-statements, conditions, comparisons, or the like. For example, multiple "if-then" sub-statements must be true in order for the entire "if-then" statement/comparison to be true. The various other sub-statements or comparisons can be related to various other parameters that can be indicative of priming status. For example, the sub-statements can include a comparison of changes to various other performance values, such as other aspects of power, motor speed, flow rate, and/or flow pressure. Various numbers and types of sub-statements can be used depending upon the particular system. Further still, process 200 and/or the routine 300 can be configured to interact with (i.e., send or receive information to or from) another means for controlling the pump 12, 112, such as a separate controller, a manual control system, and/or even a separate program running within the first controller 30, 130. The second means for controlling the pump 12, 112 can provide information for the various sub-statements as described above. For example, the information provided can include motor speed, power consumption, flow rate or flow pressure, or any changes therein, or even any changes in additional features cycles of the pumping system 10, 110 or the like.

In addition to the methodologies discussed above, the present invention can also include the various components configured to determine the priming status of the pumping system 10, 110 for moving water of an aquatic application. For example, the components can include the water pump 12, 112 for moving water in connection with performance of an operation upon the water and the variable speed motor 24, 124 operatively connected to drive the pump 12, 112. The pumping system 10, 110 can further include means for determining a reference power consumption of the motor 24, 124 based upon a performance value of the pumping system 10, 110, means for determining an actual power consumption of the motor 24, 124, and means for comparing the reference power consumption and the actual power consumption. The pumping system 10, 110 can further include means for determining a priming status of the pumping system 10, 110 based upon the comparison of the reference power consumption and the actual power consumption. The priming status can include at least one of the group of a primed condition and an unprimed condition. In addition or alternatively, the pumping system 10, 110 can include means for operating the motor 24, 124 at a motor speed and/or means for altering control of the motor 24, 124 based upon the priming status. It is to be appreciated that the pumping system 10, 10 discussed herein can also include any of the various other elements and/or methodologies discussed previously herein.

It is also to be appreciated that the controller (e.g., 30 or 130) may have various forms to accomplish the desired functions. In one example, the controller 30 can include a computer processor that operates a program. In the alternative, the program may be considered to be an algorithm. The program may be in the form of macros. Further, the program may be changeable, and the controller 30, 130 is thus programmable.

Figure 4:
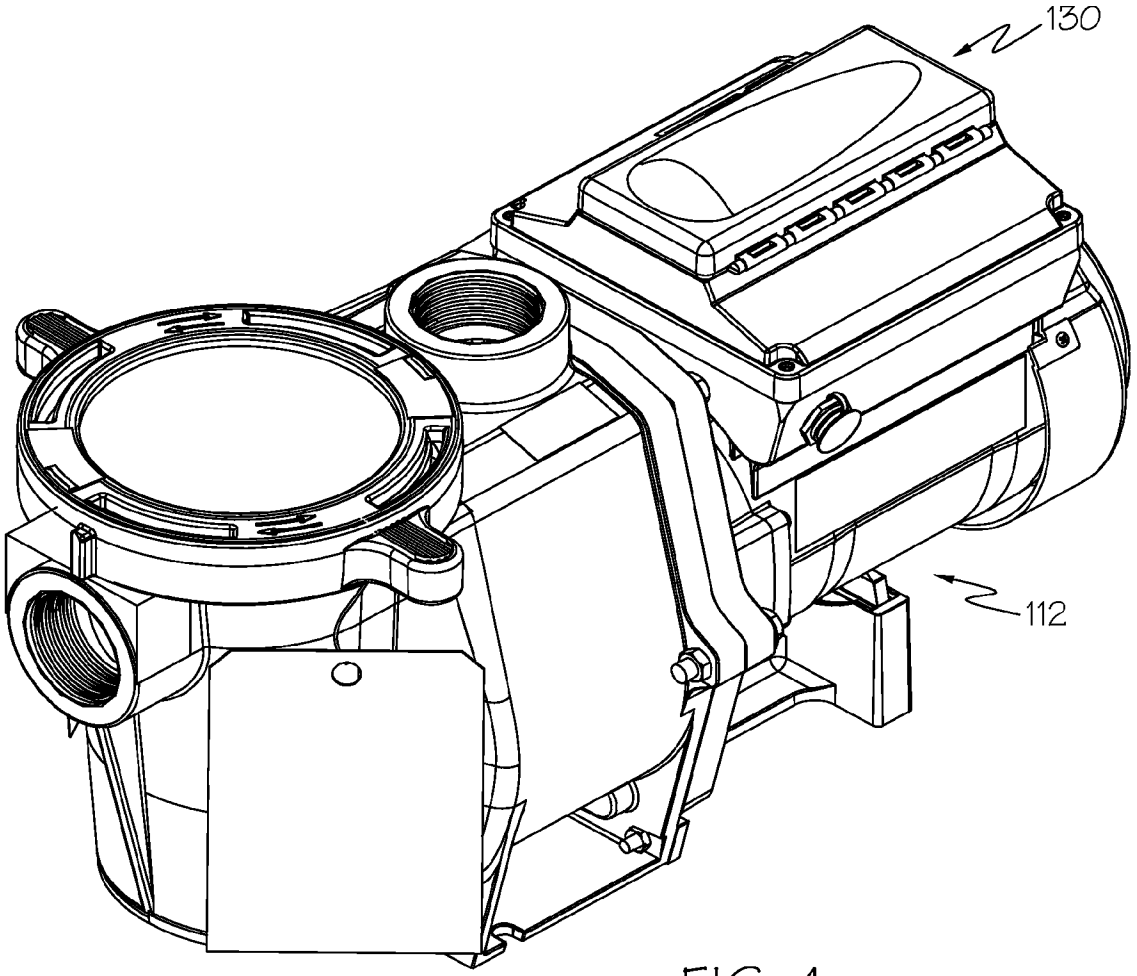
FIG. 4 is a perceptive view of an example pump unit that incorporates the present invention.
Figure 5:
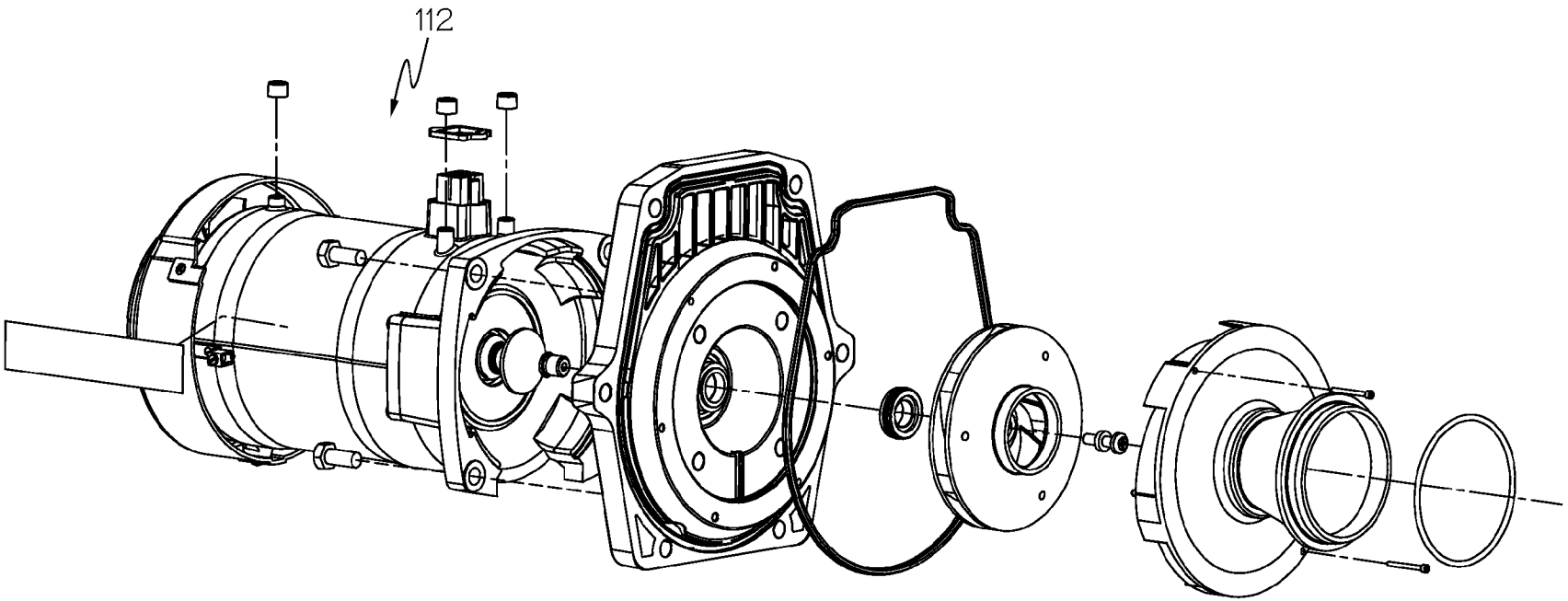
FIG. 5 is a perspective, partially exploded view of a pump of the unit shown in FIG. 4.
Figure 6:
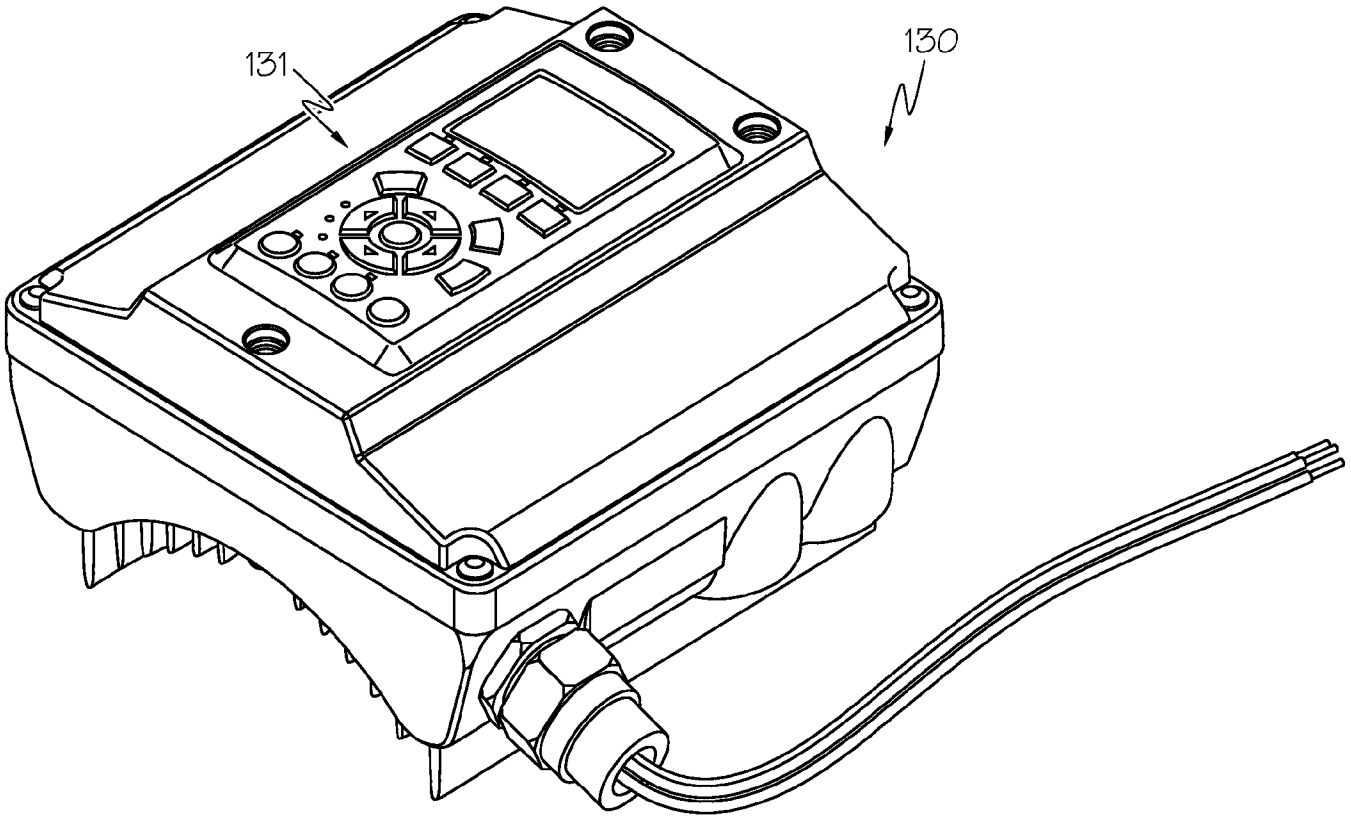
FIG. 6 is a perspective view of a control unit of the pump unit shown in FIG. 4.

Also, it is to be appreciated that the physical appearance of the components of the system (e.g., 10 or 110) may vary. As some examples of the components, attention is directed to FIGS. 4-6. FIG. 4 is a perspective view of the pump unit 112 and the controller 130 for the system 110 shown in FIG. 2. FIG. 5 is an exploded perspective view of some of the components of the pump unit 112. FIG. 6 is a perspective view of the controller 130 and/or user interface 131.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

The invention claimed is:

1. A pumping system for at least one aquatic application, the pumping system comprising:
- a pump;
- a motor coupled to the pump; and
- a controller in communication with the motor,
  - the controller determining an actual power consumption of the motor,
  - the controller comparing the actual power consumption to a reference power consumption,
  - the controller determining that the pump is in an unprimed condition if the actual power consumption is less than the reference power consumption, and
  - the controller determining that the pump is in a primed condition if the actual power consumption is at least equal to the reference power consumption for a plurality of process iterations within a user input timeout value.

2. A pumping system for at least one aquatic application, the pumping system comprising:
- a pump;
- a motor coupled to the pump; and
- a controller in communication with the motor,
  - the controller determining an actual power consumption of the motor,
  - the controller comparing the actual power consumption to a reference power consumption,
  - the controller determining that the pump is in an unprimed condition if the actual power consumption is less than the reference power consumption, and
  - the controller determining that the pump is in a primed condition if the actual power consumption is at least equal to the reference power consumption,
  - wherein the controller increments a prime counter when the actual power consumption is less than the reference power consumption and decrements the prime counter when the actual power consumption is greater than the reference power consumption,
  - wherein the controller determines a priming status based on whether the prime counter exceeds a high threshold value in order to be considered in a first unprimed condition, and wherein the controller increases a speed of the motor,
  - wherein the controller determines a new reference power consumption and a new actual power consumption relative to the increased speed of the motor, the new reference power consumption becoming the reference power consumption and the new actual power consumption becoming the power consumption for use in determining whether the pump is in the primed condition or the unprimed condition.

3. The pumping system of claim 2, wherein the controller determines a loss of prime upon determining a decrease in actual power consumption.

4. The pumping system of claim 3, wherein the decrease in actual power consumption is indicated by at least one of a relative amount of decrease, a comparison of decreased values, time elapsed since a decrease, and a number of consecutive decreases.

5. The pumping system of claim 3, wherein the decrease in actual power consumption is based on a measurement of at lease one of current and voltage provided to the motor.

6. The pumping system of claim 2, wherein the controller automatically restarts the pumping system if the pumping system has been shut down due to an unsuccessful priming condition.

7. The pumping system of claim 2, wherein the controller determines the reference power consumption based on a speed of the motor.

8. The pumping system of claim 2, wherein the controller compares a current actual power consumption to a previous actual power consumption.

9. The pumping system of claim 2, wherein the controller determines a priming status based on whether the prime counter exceeds a low threshold value in order to be considered in the primed condition.

10. The pumping system of claim 9, wherein the low threshold value is about negative twenty.

11. The pumping system of claim 9, wherein the controller switches to a flow control mode when the controller determines the primed condition.

12. The pumping system of claim 2, wherein the high threshold value is about positive twenty.

13. The pumping system of claim 2, wherein the speed of the motor is increased by about 20 revolutions per minute.

14. The pumping system of claim 2, wherein if the controller determines a second unprimed condition, the controller increases a speed of the motor to a maximum motor speed.

15. The pumping system of claim 14, wherein the controller determines whether the actual power consumption is greater than a priming power threshold when the motor is operating at the maximum motor speed.

16. The pumping system of claim 15, wherein the controller switches to a flow control mode when the controller determines that the actual power consumption is greater than the priming power threshold.

17. The pumping system of claim 16, wherein the controller determines whether the pumping system is stable at a substantially constant flow rate.

* * * * *